US007275803B2

(12) United States Patent
Lessard

(10) Patent No.: US 7,275,803 B2
(45) Date of Patent: Oct. 2, 2007

(54) SYSTEM AND METHOD FOR PRINTING A CODE ON AN ELONGATE ARTICLE AND THE CODE SO PRINTED

(75) Inventor: Robert Lessard, St-Janvier (CA)

(73) Assignee: Autolog, Inc., Blainville, Quebec (CA)

( * ) Notice: Subject to any disclaimer, the term of this patent is extended or adjusted under 35 U.S.C. 154(b) by 316 days.

(21) Appl. No.: 10/802,925

(22) Filed: Mar. 18, 2004

(65) Prior Publication Data

US 2004/0207710 A1 Oct. 21, 2004

(30) Foreign Application Priority Data

Mar. 18, 2003 (CA) ..... 2422499

(51) Int. Cl.
*B41J 2/145* (2006.01)

(52) U.S. Cl. ..... 347/40; 347/12

(58) Field of Classification Search ..... 347/40, 347/12; 235/462.01, 462.02, 462.04
See application file for complete search history.

(56) References Cited

U.S. PATENT DOCUMENTS

| | | | | |
|---|---|---|---|---|
| 3,736,870 | A | 6/1973 | Johnson et al. | 101/329 |
| 4,172,417 | A | 10/1979 | Fardeau et al. | 101/114 |
| 4,220,115 | A | 9/1980 | Brossman et al. | 118/684 |
| 4,460,905 | A | 7/1984 | Thomas | 346/140 R |
| 4,627,349 | A | 12/1986 | Claussen | 101/348 |
| 4,631,556 | A * | 12/1986 | Watanabe et al. | 347/30 |
| 5,074,244 | A | 12/1991 | Byers | 118/669 |
| 5,365,812 | A | 11/1994 | Harnden | 83/34 |
| 5,434,428 | A | 7/1995 | Paladini | 250/559.24 |
| 5,761,070 | A | 6/1998 | Conners et al. | 364/478.11 |
| 5,997,669 | A * | 12/1999 | Aman et al. | 156/64 |
| 6,090,027 | A | 7/2000 | Brinkman | 493/54 |
| 6,196,663 | B1 * | 3/2001 | Wetchler et al. | 347/43 |
| 6,250,747 | B1 * | 6/2001 | Hauck | 347/86 |
| 6,312,124 | B1 | 11/2001 | Desormeaux | 347/109 |
| 6,366,351 | B1 | 4/2002 | Ethier et al. | 356/237.1 |
| 6,378,205 | B1 | 4/2002 | Yoshihira et al. | 29/890.1 |
| 6,382,091 | B1 | 5/2002 | Speranza | 101/35 |
| 6,539,830 | B1 | 4/2003 | Koskovich | 83/13 |
| 6,543,893 | B2 | 4/2003 | Desormeaux | |
| 6,561,619 | B1 * | 5/2003 | Shibata et al. | 347/33 |
| 6,905,538 | B2 * | 6/2005 | Auslander | 106/31.15 |
| 2002/0027572 | A1 | 3/2002 | Kato et al. | 347/15 |
| 2002/0041372 | A1 | 4/2002 | Gardner et al. | 356/71 |
| 2002/0097833 | A1 | 7/2002 | Kaiser et al. | 378/45 |
| 2002/0113125 | A1 * | 8/2002 | Schuessler et al. | 235/462.1 |
| 2002/0191036 | A1 | 12/2002 | Park | 347/4 |
| 2003/0009258 | A1 | 1/2003 | Conry | 700/225 |
| 2003/0043246 | A1 | 3/2003 | Codos | 347/102 |
| 2003/0142151 | A1 | 7/2003 | Yashima et al. | 347/6 |

FOREIGN PATENT DOCUMENTS

| | | |
|---|---|---|
| JP | 04336251 | 11/1992 |
| WO | WO 9005067 | 5/1990 |

* cited by examiner

*Primary Examiner*—Lamson Nguyen
(74) *Attorney, Agent, or Firm*—Baker & Hostetler LLP

(57) ABSTRACT

A method and apparatus for printing a redundant code on an elongate article are disclosed. The apparatus includes an ink unit, at least one printing head and a controller. The printing head includes two, or three, valves, controlled by the controller. As the elongate article passes through a printing station, the controller selectively actuates the valves to release ink, and thus print the code. The two valves are preferably aligned and laterally spaced from each other in order to print the same code twice on the article.

7 Claims, 4 Drawing Sheets

SYSTEM AND METHOD FOR PRINTING A CODE ON AN ELONGATE ARTICLE AND THE CODE SO PRINTED

FIELD OF THE INVENTION

The present invention relates to a system and method for printing a code on an elongate article, particularly a piece of wood, and the code so printed.

BACKGROUND OF THE INVENTION

Recently, there have been developments in the field of wood processing in order to automate the various processes involved therein. More particularly, it has become more prevalent to optimize planers, and to automate wood grading stations.

In this context, automatic grading systems using linear scanner need a method to identify each board and retrieve board data down the line on the lug chain. Previously, when a board is scanned, an identification code is printed on the board, which is read later on the lug chain with a machine adapted to read the code, the code is then used to retrieved the grading decision previously saved.

One of the disadvantages of such systems is that the code so printed on the piece of wood takes up too much space, or is printed with a large quantity of ink. This results in an unsightly mark, which will not come off. Alternative embodiments have used UV ink to print the code, but the UV ink has a tendency to fade to yellow in time, again resulting in unsightliness.

Finally, since the code must be printed on the piece of wood at high speeds, it can result it sloppy marks, which are unreadable by the code reading apparatus.

SUMMARY OF THE INVENTION

It is an object of the invention to provide a method and apparatus for marking a piece of wood which obviates the disadvantages of the prior art mentioned above. It is also an object of the invention to provide a code which is discreet, and which is redundant, increasing the accuracy of the reading apparatus.

In accordance with a preferred embodiment of the invention, this object is achieved with an apparatus for printing a code on an elongate article passing through a printing station, said article passing through said station in a longitudinal direction, said apparatus comprising:

an ink unit for storing ink to be delivered;

at least one printing head, said printing head being operatively connected to said ink unit, said printing head including at least two valves, said valves being laterally spaced from each other; and a controller for controlling said ink unit and said at least one printing head, so that said controller is adapted to actuate said valves in order to print a code on said elongate article as said article passes through said printing station, said code being printed at least twice on said elongate article.

In accordance with another object of the invention, there is provided a method for printing a redundant code on an elongate article as said elongate article passes through a printing station, comprising the steps of:

(a) providing an ink unit;

(b) providing at least one printing head, said printing head including at least two valves being laterally spaced from each other;

(c) providing a controller operatively associated with said ink unit and said at least one printing head; and (d) actuating said valves with said controller in order to print said code.

In accordance with yet another object of the invention, this object is achieved with a code to be printed on a piece of wood, said code comprising a longitudinal area within which a plurality of lines may or may not be printed. Furthermore, the code is preferably printed at least twice simultaneously, the at least two codes being laterally spaced from each other, to provide redundancy.

BRIEF DESCRIPTION OF THE FIGURES

The present invention will be better understood after reading a description of a preferred embodiment thereof, made in reference to the following drawings in which.

DESCRIPTION OF A PREFERRED EMBODIMENT OF THE INVENTION

Figure 1:
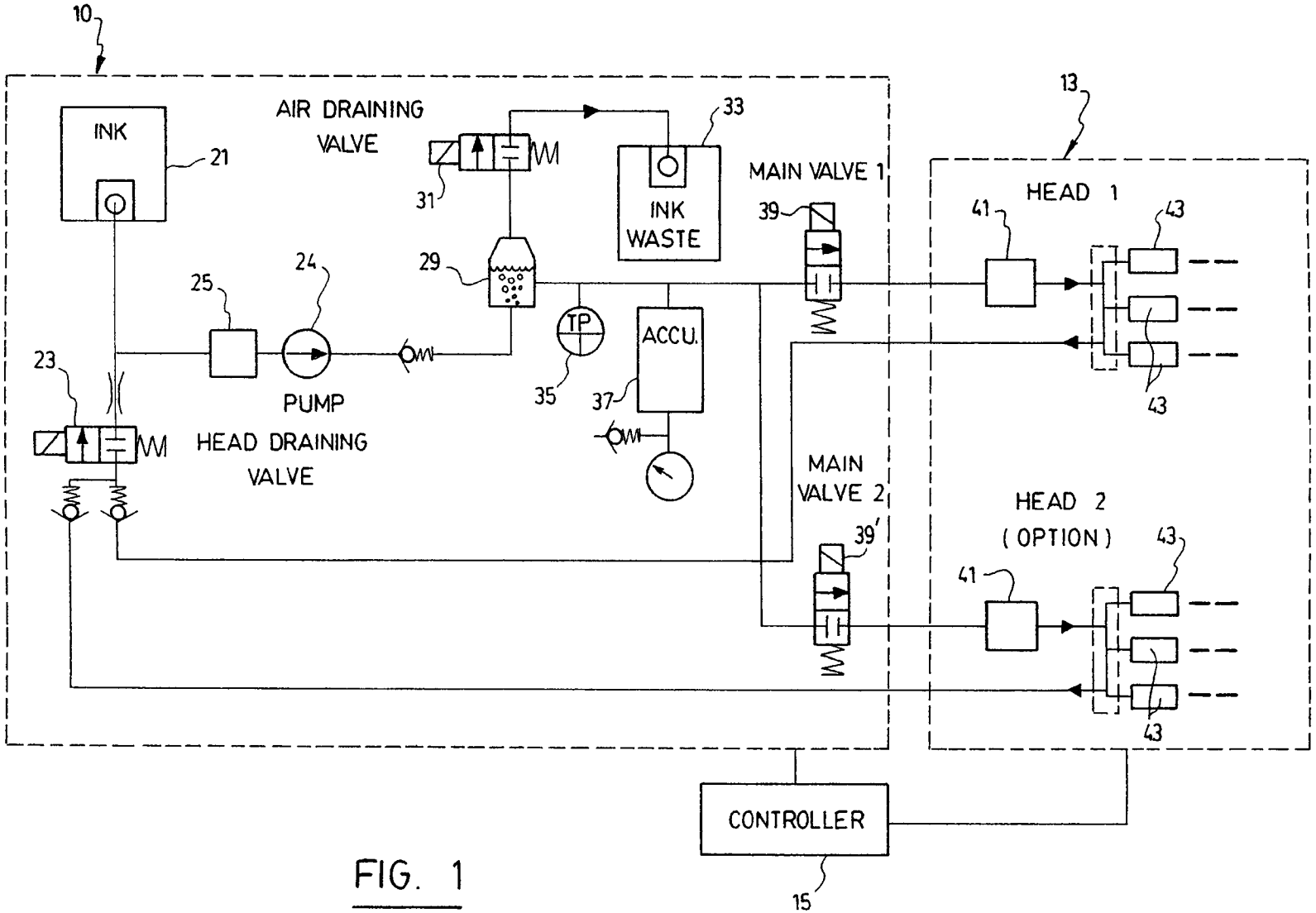
FIG. 1 is a schematic representation of the printing system according to a preferred embodiment of the invention.

Referring now to FIG. 1, there is shown a schematic representation of the system for printing a code on an elongate article.

As mentioned in the prior art, printing a code on an elongate article has been done previously. However, the codes so printed are generally large, and there has not been previously a motivation to print a redundant code on the article. However, with an increase in speed of wood processing plants, and with an increase in the unreadability of the previous codes, there is now a need to provide a system and apparatus for printing a redundant code on a elongate article which obviates the prior art deficiencies mentioned above.

Thus, the system 10 of the present invention comprises an ink unit 11, at least one printing head 13 and a controller 15.

The ink unit 11, in a preferred embodiment, includes an ink reservoir 21, preferably of the type "bag-in-box". Other components include a return valve 23, filter 25, pump 27, air eliminator 29, bleeding valve 31 associated with reservoir 33, pressure transducer 35, pressure reservoir 37 and main valve 39, all interconnected in the usual manner. A person skilled in the art will appreciate that the above description is for a standard printing circuit, and that variations are well within the scope of the present invention.

The printing head 13 includes a filter 41 and at least two, preferably three, valves 43. In a preferred embodiment, the valves 43 are micro-valves, which are adapted to open and close rapidly, spraying droplets of ink. The valves are also preferably aligned with each other, and laterally spaced apart.

A controller 15 controls all of the elements of the ink unit 11, and the printing head 13.

The code that is to be printed takes up a predetermined length (footprint) on the piece of wood. The code word is comprised of a plurality of "bits", which may be on (presence of the bit) or off (absence of the bit). In a preferred embodiment, each bit is a longitudinal line, preferably printed with UV ink. The bits are printed by the controller sending a signal to the valves to open for a predetermined amount of time. In the context of processing wood in a wood processing plant, the valves are only open for a few microseconds. However, given the speed at which the wood travels, this results in each bit being approximately 1 cm long. The footprint of the code is approximately 25 cm, leaving sufficient time (or space) between successive bits that there would not be confusion between two successive "on" bits.

The code word according to a preferred embodiment of the invention is comprised of ten bits. However, it will be appreciated that more or less bits may also fulfill the objects of the present invention, according to the needs of the particular user.

Figure 2:
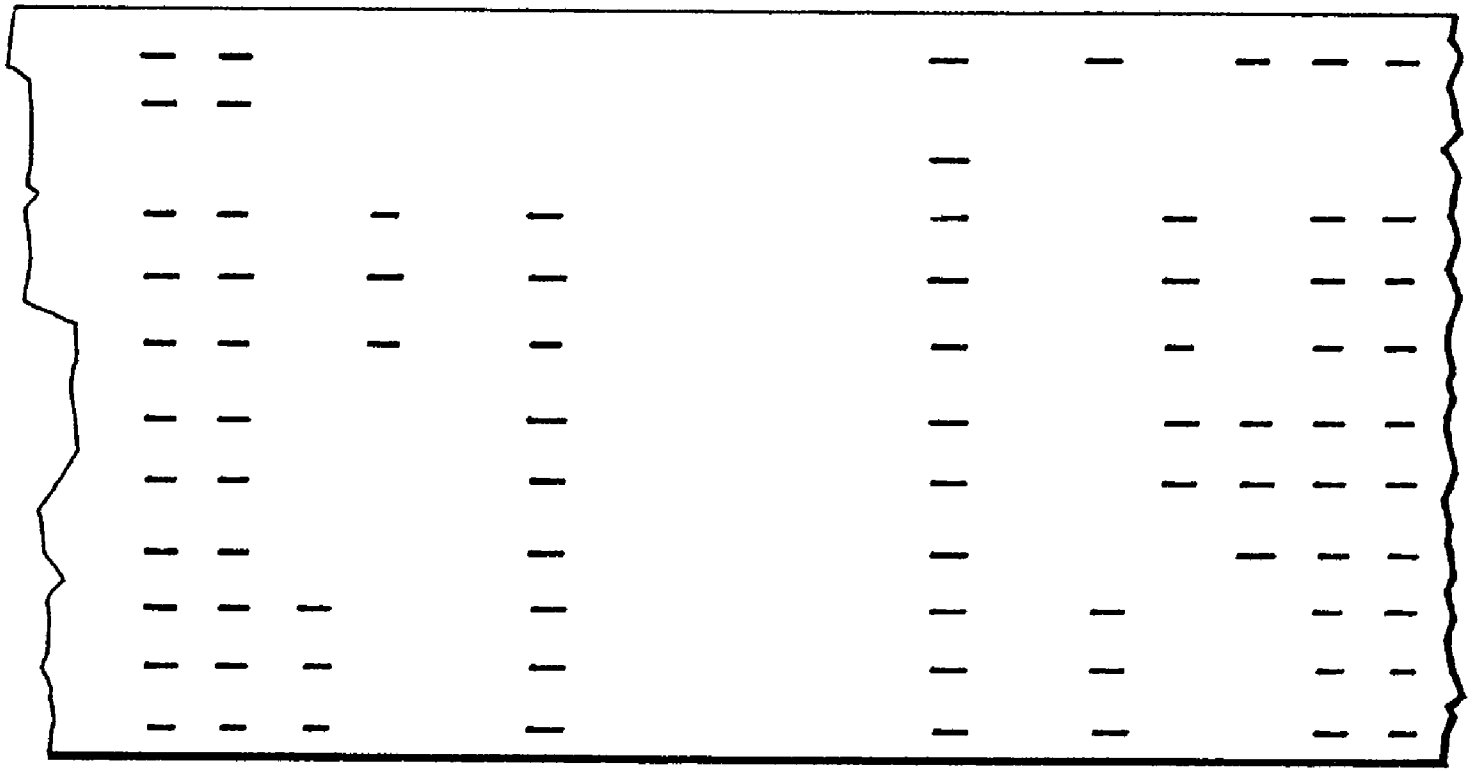
FIG. 2 is a photograph of a plurality of wood boards printed with the system of FIG. 1.

As mentioned previously, and as shown in FIG. 2, the code word is printed at least twice simultaneously, where each code is laterally spaced from the other one. In a more preferred embodiment, the code is printed three times, insuring better redundancy.

Figure 3:
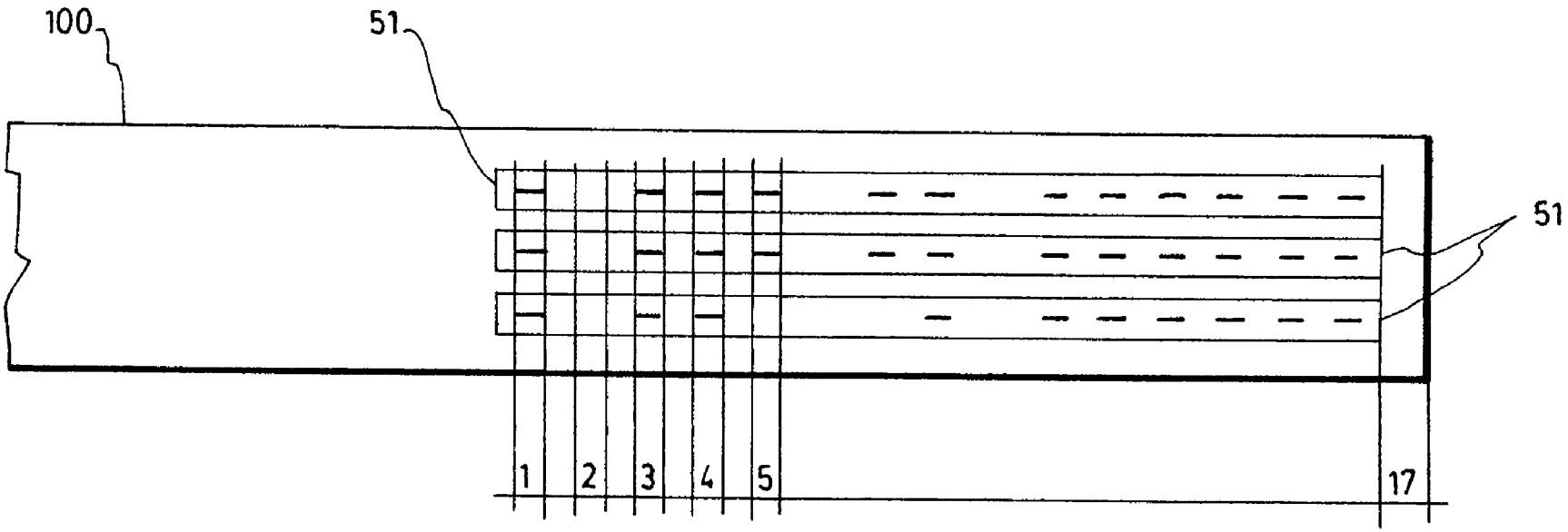
FIG. 3 is a representation of a code word according to a preferred embodiment of the invention.

Referring now to FIG. 3, there is shown three code words 51 printed simultaneously on a piece of wood 100. As can be seen, bit 1 is on, bit 2 is off, bit 3 is off, bit 4 is on, etc. If the code word were printed only once, errors could occur due to variations on the texture of the wood, presence of knots, etc. By printing the code at least twice, and preferably three times, the accuracy when reading the code downstream is further increased.

The ink used for the apparatus is preferably UV as mentioned previously. Furthermore, advantageous characteristics of the ink include fast drying, so that less ink is required, and the ink must be adapted to be readable on wood.

In another preferred embodiment of the invention, the apparatus of the present invention comprises two print heads.

Figure 4:
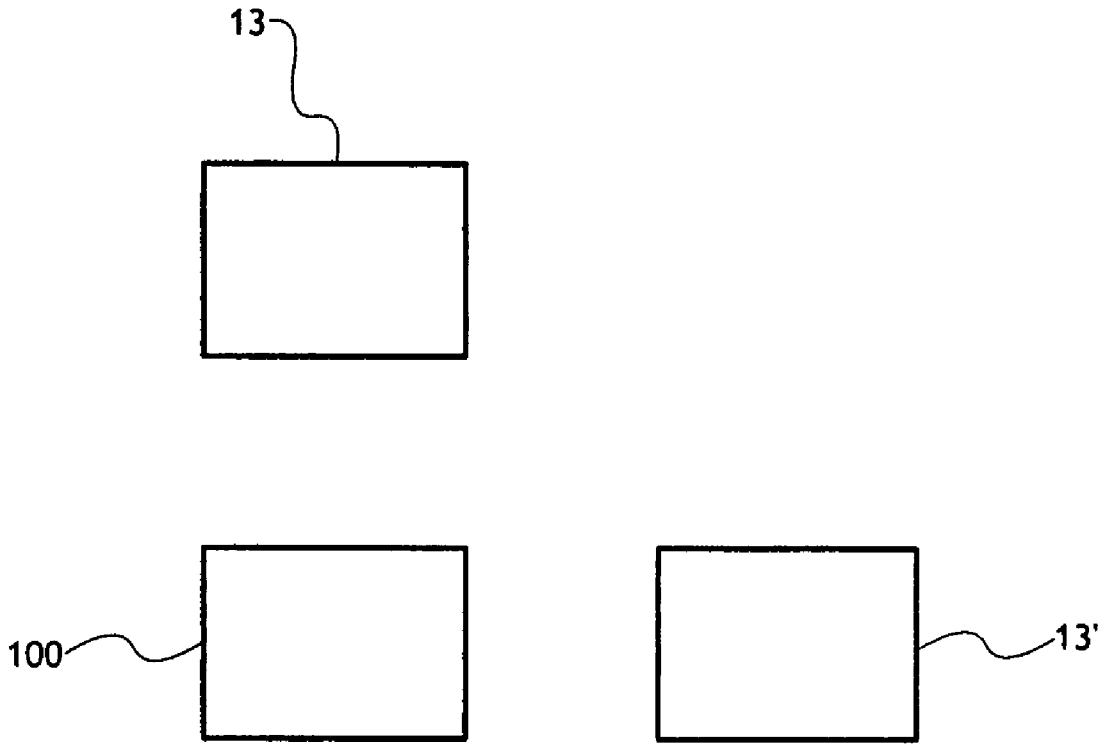
FIG. 4 is a schematic end view of an apparatus including two print heads adapted to print code on two different lateral faces of a piece of wood.

The second print head is useful to mark square boards, i.e. boards that have tendency to rotate 90 degrees, in which situation the printed mark stays on the side and cannot be detected by the code reader. The second print head is preferably mounted at a 90 degrees angle from the first print head, that is oriented to print the code on another lateral surface of the board. This embodiment is better shown in FIG. 4. This view is a schematic end view of an apparatus according to an embodiment of the present invention where the apparatus includes two print heads 13 and 13' adapted to print the code on two separate lateral faces of the piece of wood 100.

Although the present invention has been explained hereinabove by way of a preferred embodiment thereof, it should be pointed out that any modifications to this preferred embodiment within the scope of the appended claims is not deemed to alter or change the nature and scope of the present invention.

The invention claimed is:

1. An apparatus for printing a code on elongate articles passing through a printing station in a longitudinal direction, said apparatus comprising:

an ink unit for storing ink to be delivered;

at least one printing head, said printing head being operatively connected to said ink unit, said printing head including at least two valves, said valves being laterally spaced from each other; and a controller for controlling said ink unit and said at least one printing head, so that said controller is adapted to actuate said valves in order to print a longitudinally oriented code on each at least one lateral surface of said elongate articles as said articles pass through said printing station, said code being printed at least twice on each of said elongate articles and said code being unique to each of said elongate articles.

2. An apparatus according to claim 1, wherein said valves are aligned.

3. An apparatus according to claim 1, wherein said code includes ten bits.

4. An apparatus according to claim 1, wherein said each of said printing head includes three valves, so that said code is printed three times.

5. An apparatus according to claim 1, wherein said apparatus includes two printing heads, a second printing head being oriented to print said code on another lateral surface of said elongate article.

6. An apparatus according to claim 1, wherein said ink unit includes at least: an ink reservoir; a head draining valve; a pump; an air draining valve; an ink waste reservoir; and a main valve associated with each of said at least one printing head.

7. An apparatus according to claim 1, wherein said ink is a UV ink.

* * * * *